US008720145B2

(12) United States Patent
Marshall, III

(10) Patent No.: US 8,720,145 B2
(45) Date of Patent: May 13, 2014

(54) MOUNTING ARRANGEMENT FOR A FOUNDATION WALL VAPOR BARRIER

(71) Applicant: Henry Bennie Marshall, III, Pawleys Island, SC (US)

(72) Inventor: Henry Bennie Marshall, III, Pawleys Island, SC (US)

( * ) Notice: Subject to any disclaimer, the term of this patent is extended or adjusted under 35 U.S.C. 154(b) by 0 days.

(21) Appl. No.: 13/679,516

(22) Filed: Nov. 16, 2012

(65) Prior Publication Data

US 2013/0125481 A1 May 23, 2013

Related U.S. Application Data

(60) Provisional application No. 61/561,580, filed on Nov. 18, 2011.

(51) Int. Cl.

| | |
|---|---|
| ***E04B 5/00*** | (2006.01) |
| ***E02D 19/00*** | (2006.01) |
| ***E04B 1/62*** | (2006.01) |
| *E02D 31/02* | (2006.01) |

(52) U.S. Cl.
CPC .. *E04B 1/62* (2013.01); *E02D 31/02* (2013.01)
USPC ..... 52/411; 52/169.14

(58) Field of Classification Search
USPC ..... 52/408, 409, 410, 411, 412, 428, 52/169.14; 442/149, 151, 165; 448/343, 448/351, 354
See application file for complete search history.

(56) References Cited

U.S. PATENT DOCUMENTS

| | | | | |
|---|---|---|---|---|
| 3,035,374 | A | 5/1962 | Burris | |
| 3,424,647 | A | 1/1969 | Callahan et al. | |
| 4,421,807 | A | 12/1983 | Clausing et al. | |
| 4,735,838 | A | 4/1988 | Roberts et al. | |
| 5,091,235 | A | 2/1992 | Vergnano | |
| 5,254,399 | A * | 10/1993 | Oku et al. | 442/351 |
| 5,495,696 | A * | 3/1996 | Repka | 52/169.5 |
| 5,630,299 | A | 5/1997 | Jackman et al. | |
| 5,983,586 | A | 11/1999 | Berdan et al. | |
| 6,256,956 | B1 * | 7/2001 | Davis | 52/408 |
| 6,575,666 | B1 | 6/2003 | Janesky | |
| 6,881,247 | B2 | 4/2005 | Batdorf | |
| 6,905,563 | B2 | 6/2005 | Dong | |
| 6,926,469 | B2 | 8/2005 | Janesky | |
| 7,060,155 | B2 | 6/2006 | Dong et al. | |
| 7,421,826 | B2 * | 9/2008 | Collins et al. | 52/302.1 |
| 7,735,271 | B1 * | 6/2010 | Shipston et al. | 52/169.11 |
| 7,856,767 | B2 | 12/2010 | Janesky | |
| 8,007,205 | B2 | 8/2011 | Marshall, III | |
| 2004/0040227 | A1 | 3/2004 | Tozaka et al. | |
| 2004/0103608 | A1 * | 6/2004 | Lionel | 52/408 |

(Continued)

*Primary Examiner* — William Gilbert
*Assistant Examiner* — Kyle Walraed-Sullivan
(74) *Attorney, Agent, or Firm* — McNair Law Firm, P.A.; Seann P. Lahey

(57) ABSTRACT

A vapor barrier for mounting and sealing on a foundation wall using adhesive. The vapor barrier includes a moisture impervious sheet having a first exterior side surface arranged to extend adjacent to and downward along the foundation wall when mounted. An adhesion strip is secured to the first exterior side surface being adapted to absorb an adhesive placed on the foundation wall for securing the moisture impervious sheet to the foundation wall. The adhesion strip comprising a porous synthetic fibrous web capable of distributing the adhesive completely through the adhesion strip to the first exterior side surface of the moisture impervious sheet during mounting to the foundation wall so that an air and moisture tight seal is formed between the foundation wall, the adhesion strip, and the moisture impervious sheet.

20 Claims, 4 Drawing Sheets

(56) References Cited

U.S. PATENT DOCUMENTS

| | | | | |
|---|---|---|---|---|
| 2004/0137813 | A1 | 7/2004 | Faucher | |
| 2005/0210772 | A1 | 9/2005 | Janesky | |
| 2005/0246990 | A1 | 11/2005 | Geska et al. | |
| 2007/0130849 | A1 | 6/2007 | Langer et al. | |
| 2007/0130864 | A1* | 6/2007 | Semmens et al. | 52/408 |
| 2007/0157533 | A1 | 7/2007 | Janesky et al. | |
| 2007/0175112 | A1* | 8/2007 | Janesky | 52/169.5 |
| 2007/0204530 | A1 | 9/2007 | Janesky | |
| 2007/0224003 | A1 | 9/2007 | Janesky | |
| 2008/0120935 | A1* | 5/2008 | Lembo | 52/408 |

* cited by examiner

MOUNTING ARRANGEMENT FOR A FOUNDATION WALL VAPOR BARRIER

FIELD OF THE INVENTION

This invention is directed to foundation wall vapor barriers, and more particularly, to a system for mounting and sealing a vapor barrier to a foundation wall using only a low volatile organic compound (VOC) environmentally friendly adhesive and which forms an airtight and moisture tight seal between the vapor barrier and foundation wall.

BACKGROUND OF THE INVENTION

A crawlspace is a low or narrow space, such as one beneath the upper or lower story of a building that gives workers access to items such as plumbing or wiring equipment. In residential structures, typically, this space is defined by the structures foundation walls so that the crawlspace is enclosed under the lowest floor of the structure. Foundation walls are generally composed of concrete blocks or poured concrete walls. The bottom of the crawlspace is generally ground, which in most cases is simply dirt or sand. In other cases, the ground floor may be poured concrete. The floor above the crawlspace is generally made of wood. Additionally, the crawlspace dirt floor is generally lower then the soil surrounding the structure. Further, the crawlspace is generally not well insulated, and due to leaks, cracks and vents, is generally exposed to the outside environment.

Due to limited air flow in a crawlspace, moisture that seeps out of the ground and into the crawlspace causes the crawlspace to become damp and may stay damp for extended periods of time. This moisture can be very damaging to the structure's foundation walls, floor joists, and other structural components, often leading to premature deterioration of the structure and costly repairs. Additionally, mold, mildew, insects and other undesirable conditions can develop in the crawlspace which can affect the foundation walls and produce an unhealthy environment for inhabitants within the living spaces of the structure above. Additionally, the non-insulated crawlspace allows for the temperature differential between the living space of a home and the crawlspace to approach or be equal to the temperature differential between the living space and the outdoors.

Due to the enclosed nature of the crawlspace, volatile materials, such as construction grade adhesives, that create a hazardous environment, whether through flammable vapors or toxic fumes, is highly undesirable for poorly ventilated spaces. For example, adhesives that produce toxic fumes or flammable vapors are not desirable to use on foundation walls as they can accumulate in the crawlspace, creating a fire hazard due to low ventilation.

Further, such undesirable contaminants in the crawlspace can flow into the air of the structure itself. The natural air flow in a structure is from bottom to top. Based on the principal that warm air rises, as the air in the structure heats up, it moves up through the structure. Once this warm air makes it way up to the attic and roof levels, it will normally be vented out though the soffits or a ridge vent. Much of the air that flows in a structure comes from the crawlspace. In older, more "leaky structures", the air exchange rate can be as high as two air changes per hour. It has been estimated that up to half of the air you breathe on the first floor of a structure is air that came from the crawlspace. If there is high humidity in the crawlspace, there will be higher humidity in the living space. If there is mold and mildew in the crawlspace, there could be mold and mildew in the structure.

Additionally, when air leaks through the foundation walls into the crawlspace and flows into the living space, the temperature differential can undesirably heat or cool the living space therefore requiring more energy to maintain the temperature in the living space. Historically, the design of the crawlspace requires that the crawlspace be open with vents so that air flow can occur in the crawlspace. These vents are an attempt to reduce moisture in the crawlspace. However, these vents allow ambient air to enter the crawlspace.

By providing a vapor barrier to the foundation wall, much of the moisture that enters a crawlspace can be eliminated. A problem arises in that typical construction adhesives capable of securing a plastic liner to a concrete foundation wall have high VOC levels and emit dangerous amounts of toxic and flammable vapor, which is a fire hazard for an enclosed area such as a crawlspace. To avoid the use of such dangerous adhesives, mechanical fasteners have been required to secure the vapor barrier to the foundation wall. This typically involves drilling into the foundation walls to properly secure the vapor barrier to the foundation walls. Installation of such systems has thus largely been limited to professional installers with the tools and abilities to accomplish such a task.

Further, it is desirable for the barrier to contain an antimicrobial property to provide additional protection against undesirable items such as mold and bacteria. With the proper barrier, moisture levels and air infiltration can be better controlled resulting in less of a chance for mold and mildew growth, wood rot, and insects and animals entering the crawlspace.

While there have been several efforts to provide proper barriers for crawlspaces, the installation of these barriers has proven challenging. One principal factor contributing to the difficulty is that the environment of the crawlspace makes adhering the barrier to the foundation walls challenging.

One method for securing the barrier to the foundation walls is disclosed in U.S. Pat. No. 6,575,666. This patent discloses a crawlspace encapsulation system the uses nylon fasteners to secure and support the liner vertically on the foundation walls. The patent states that adhesive tape or a suitable adhesive caulk composition is used to seal the end of the vapor barrier against the top side of the foundation walls, but not to mount or support the liner on the walls. This is because low VOC adhesives suitable for holding to the foundation walls are not suitable for adhering to plastic liners of the type used in crawlspaces. For example, a concrete adhesive, while working well for concrete, does not adhere well to plastic film, particularly the type used for vapor barriers. This difficultly with adhesion is compounded when the plastic film is treated with an antimicrobial substance. Therefore, there is a need for a system for securing and sealing a vapor barrier to a foundation wall that does not require mechanical fasteners or high VOC adhesives. Thus, it would be advantageous to have adhesive and other materials for enclosing a crawlspace having desirable fire retardants and low volatile organic compound (VOC) levels.

Accordingly, it is an object of the present invention to provide an adhesive attaching arrangement for permanently securing a vapor barrier to a foundation wall using a low VOC adhesive which further forms an airtight and moisture tight seal between the foundation wall and the vapor barrier.

It is a further object of the present invention to provide a vapor barrier having fire retardant and antimicrobial properties.

SUMMARY OF THE INVENTION

The above objectives are accomplished according to the present invention by providing a vapor barrier for mounting and sealing on a foundation wall comprising a moisture impervious sheet having a first exterior side surface arranged to extend adjacent to and downward along said foundation wall when mounted; an adhesion strip secured to said first exterior side surface being adapted to absorb an adhesive placed on the foundation wall for securing said moisture impervious sheet to the foundation wall; wherein said adhesion strip comprising a porous synthetic fibrous web capable of distributing said adhesive completely through said adhesion strip to said first exterior side surface of said moisture impervious sheet during mounting to said foundation wall so that an air and moisture tight seal is formed between the foundation wall, said adhesion strip, and said moisture impervious sheet. By providing a porous adhesion strip on the exterior of the moisture impervious sheet, a nonvolatile low-VOC compliant non-solvent adhesive can be used in the crawlspace to secure the wall vapor barrier to the foundation walls without any mechanical fasteners or concerns with adhesives that are not low-VOC compliant.

In a further advantageous embodiment, the porous synthetic fibrous web consists of non-woven hydroentangled spun-lace PET polyester fibers entangled in both a vertical and horizontal direction to promote strength and durability.

In a further advantageous embodiment, the adhesion strip is selected with a weight in the range of 5-300 grams per square meter providing a high void volume to facilitate absorption of said adhesive through to said moisture impervious sheet.

In a further advantageous embodiment, the moisture impervious sheet is selected from the group consisting of plastic film sheeting and rubberized sheeting.

In a further advantageous embodiment, the moisture impervious sheet consists of a solid single layered vinyl sheet.

In a further advantageous embodiment, the adhesion strip is secured to said first exterior side surface of said moisture impervious sheet using an adhesive selected from the group consisting of water-based, solvent based, PUR, silicone, epoxy, acrylic, conventional or cross linkable hot melt adhesive, and thermoplastics.

In a further advantageous embodiment, the adhesion strip is secured to said first exterior side surface of said moisture impervious sheet using an adhesive film carried on a back side of said adhesion strip.

In a further advantageous embodiment, the adhesion strip is secured to said first exterior side surface of said moisture impervious sheet using a double-sided adhesive tape.

In a further advantageous embodiment, the double-sided adhesive tape includes a dry mount adhesive on at least one side for bonding to said adhesion strip.

In a further advantageous embodiment, the adhesion strip is selected from the group consisting of woven and nonwoven synthetic fabric materials.

In a further advantageous embodiment, at least one of said adhesion strip and said moisture impervious sheet includes at least one of a fire retardant and a antimicrobial treatment.

In a further advantageous embodiment, the adhesion strip ranges in thickness from approximately 1-20 mil to support said moisture impervious sheet and so that said adhesive is absorbed completely through to said moisture impervious sheet.

The above objectives are further accomplished according to the present invention by providing a method of installing a vapor barrier to a foundation wall comprising the steps of: providing a moisture impervious sheet; non-releasably bonding an adhesion strip to a first exterior side surface of said moisture impervious sheet, wherein said adhesion strip comprises a porous synthetic fibrous web adapted to absorb and distributing an adhesive completely through said adhesion strip to said first exterior side surface of said moisture impervious sheet, and wherein said adhesion strip is capable of supporting the full weight of said moisture impervious sheet in a vertical hanging arrangement; applying a bead of adhesive to said foundation wall; aligning said moisture impervious sheet to said foundation wall so that said first exterior side surface extends adjacent to and downward along said foundation wall; pressing said adhesion strip into said bead of adhesive so that said adhesive is absorbed and extends through to said first exterior side surface of said moisture impervious sheet forming an air and moisture tight seal between said foundation wall, said adhesion strip, and said moisture impervious sheet.

In a further advantageous embodiment, the installation includes the step of providing said adhesion strip consisting of non-woven hydroentangled spun-lace PET polyester fibers entangled in both a vertical and horizontal direction to promote strength and durability.

In a further advantageous embodiment, the installation includes the step of selecting said adhesion strip with a weight in the range of 5-300 grams per square meter providing a high void volume to facilitate absorption of said adhesive through to said moisture impervious sheet.

In a further advantageous embodiment, the installation includes the step of selecting said moisture impervious sheet from the group consisting of plastic film sheeting and rubberized sheeting.

In a further advantageous embodiment, the installation includes the step of providing said adhesion strip having a thickness in the range of approximately 1-20 mil to support said moisture impervious sheet and so that said adhesive is absorbed completely through to said moisture impervious sheet.

In a further advantageous embodiment, the installation includes the step of non-releasably bonding said adhesion strip to said first exterior side surface of said moisture impervious sheet using an adhesive selected from the group consisting of water-based, solvent based, PUR, silicone, epoxy, acrylic, conventional or cross linkable hot melt adhesive, and thermoplastics.

In a further advantageous embodiment, the installation includes the step of applying an adhesive film to a back side of said adhesion strip for non-releasably bonding to said moisture impervious sheet.

In a further advantageous embodiment, the installation includes the step of applying a double-sided adhesive tape to a back side of said adhesions strip for non-releasably bonding to said moisture impervious sheet, wherein said double-sided adhesive tape includes a dry mount adhesive carried on at least a first side bonding to said adhesion strip, and a second side carrying an adhesive selected from the group consisting of a pressure sensitive adhesive, heat activated adhesive, and solvent activated adhesive.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
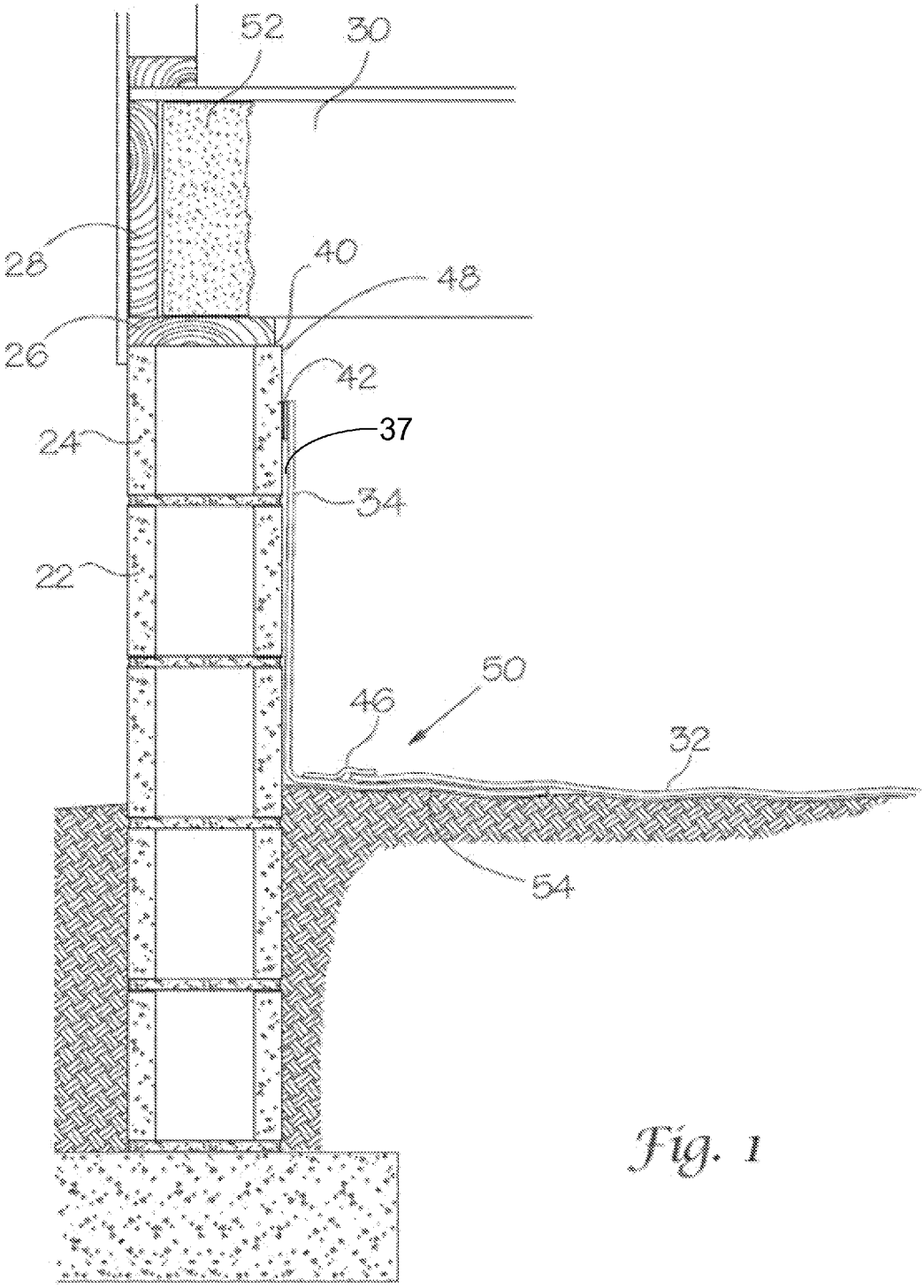
FIG. 1 shows a cross-section view of a foundation wall having a vapor barrier mounted using only a low VOC adhesive according to the present invention.

It will be understood by those skilled in the art that one or more aspects of this invention can meet certain objectives, while one or more other aspects can meet certain other objectives. These and other objects and features of the invention will become more fully apparent when the following detailed description is read in conjunction with the accompanying FIGS. and examples. However, it is to be understood that both the foregoing summary of the invention and the following detailed description are of a preferred embodiment and not restrictive of the invention or other alternate embodiments of the invention. In particular, while the invention is described herein with reference to specific embodiments, it will be appreciated that the description is illustrative of the invention and is not constructed as limiting of the invention. Various modifications and applications may occur to those who are skilled in the art, without departing from the spirit and the scope of the invention.

DETAILED DESCRIPTION OF THE INVENTION

With reference to the drawings, the invention will now be described in more detail. Referring to FIG. 2, a typical residential structure is shown having crawlspace 10 containing vents 12 that allow air to pass into the crawlspace from the exterior of structure 14. Air from within the crawlspace can travel in a direction shown generally as 16 and into the living space 18. Moisture can seep into the crawlspace through foundation walls 22 and from crawlspace ground floor 20. Additionally, the air flow from the vents causes the air in the crawlspace to be approximately the same temperature as that of the ambient air in the outside environment. Further referring to FIG. 1, by installing a vapor barrier, designated generally as 50, along foundation walls 22 and ground floor 20, the introduction of moisture into crawlspace 10 can be reduced and the flow of air upward through the structure better controlled.

Figure 2:
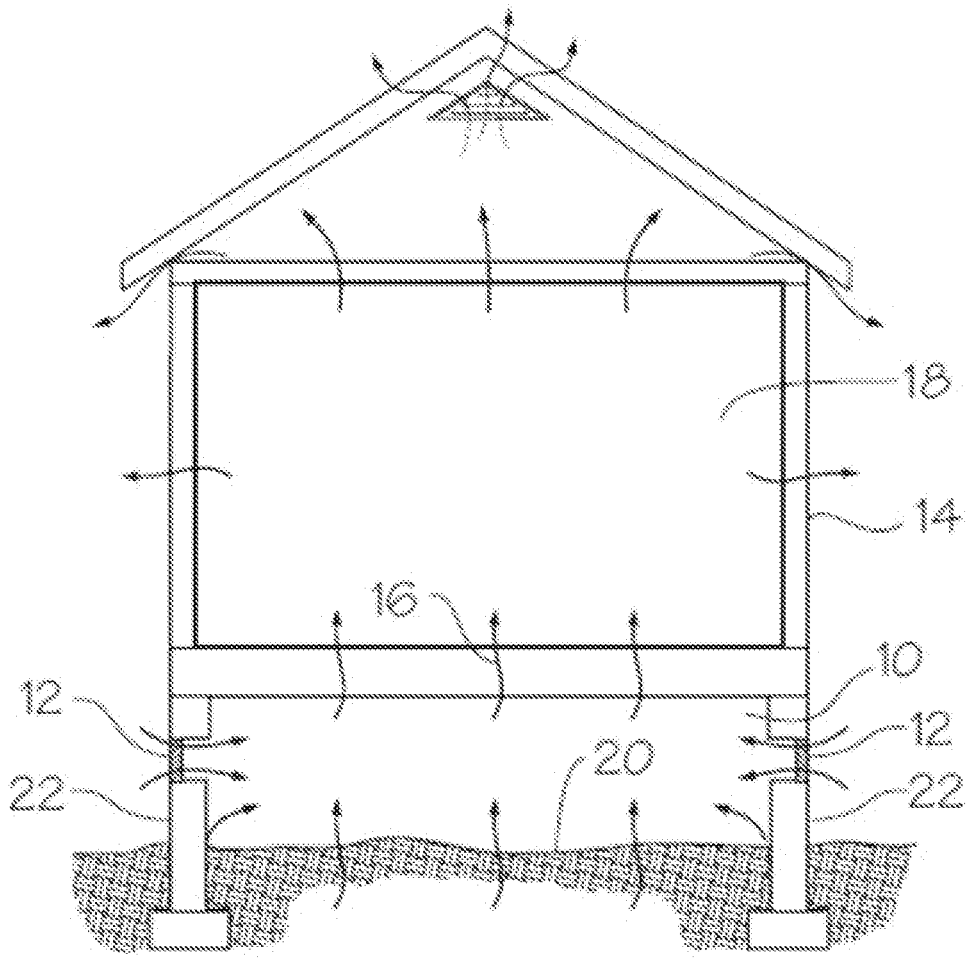
FIG. 2 shows an air flow schematic diagram of a structure involving a crawlspace.

Referring now to FIG. 1, foundation wall 22 comprises a series of blocks 24. These blocks are typically constructed from concrete, and can include sand, fine gravel, cinder, ash or other additives based upon the type of block for construction. Blocks can also be made from brick, metal or other materials. Foundation wall 22 supports sill plate 26 which in turn supports the band joist 28 and floor joist 30. Floor joist 30 supports the lower floor of the structure and also generally defines the ceiling of crawlspace 10. Typically, the blocks are hollow and are not insulated. Preferably, insulation is applied to the foundation, especially the band joist 28, to insulate the crawlspace from the outside environment. In one arrangement, insulation 52 is applied adjacent to band joist 28 around the crawlspace. Further, when vents 12 are sealed, insulation is placed against the sealed vent to further insulate the crawlspace.

In the illustrated embodiment of the present invention in FIG. 1, vapor barrier 50 may be a single piece of material that is installed on crawlspace floor 20 and runs up foundation walls 22. However, in a single piece embodiment, it is necessary for the installers to step on the portion of vapor barrier 50 that covers the floor of the crawlspace which can potentially lead to damage of the barrier. Therefore, the present invention includes a preferred embodiment where vapor barrier 50 is in two sections, a floor cover 32 and wall portion 34. When the barrier is in two sections, there is an advantage in installation since wall portion 34 can be installed first allowing the individuals that install the barrier to walk on the dirt floor without having to step on the barrier.

Figure 3A:
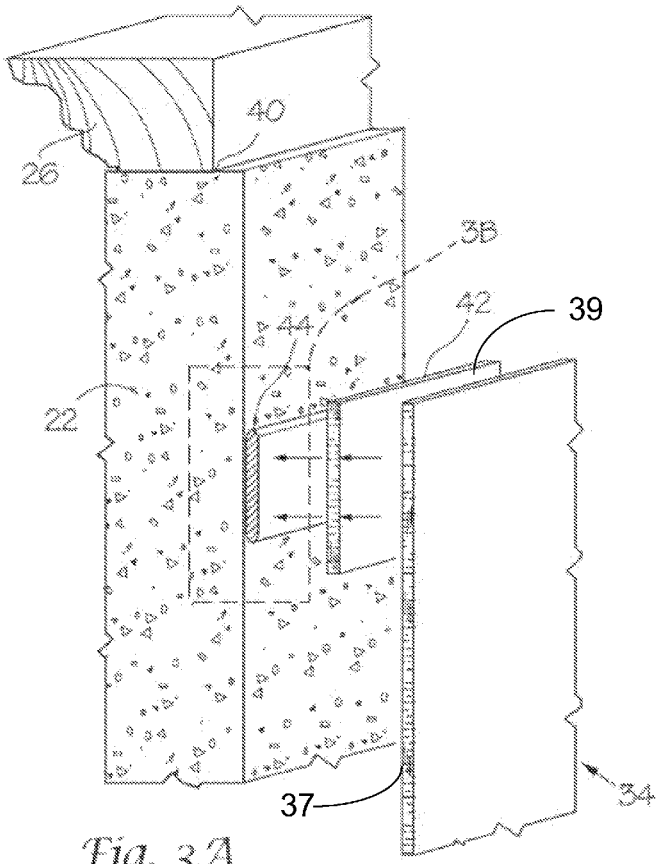
FIG. 3A shows an exploded view of the vapor barrier mounting to the foundation wall according to the present invention.
Figure 3B:
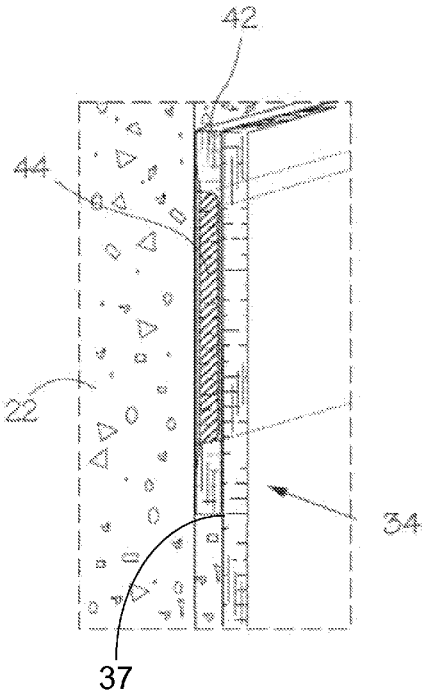
FIG. 3B shows a detailed perspective view of the vapor barrier mounting to the foundation wall according to the present invention.

Referring to FIGS. 1, 3A and 3B, vapor barrier 50 comprises a moisture impervious sheet 32, 34. In the illustrated arrangement, the moisture impervious sheet that defines vapor barrier 50 includes wall portion 34 having a first exterior side surface 37 arranged to extend adjacent to and downward along foundation wall 22, and floor cover 32 extending across the dirt floor 20.

The moisture impervious sheet 32, 34 used for vapor barrier 50 is preferably highly puncture-resistant and includes an antimicrobial property treatment to inhibit mold and bacteria that may cause staining, unpleasant odors, and premature deterioration. Preferably, moisture impervious sheet 32, 34 includes a fire retardant treatment. The fire retardant and antimicrobial properties may be inherent in the specific materials used to create vapor barrier 50 or may be added by chemical treatment as is known to those skilled in the art. Additionally, vapor barrier 50 is preferably white in color so that it is easier to see whether mold, insects or other items invade the crawlspace after the vapor barrier is installed. In one embodiment, moisture impervious sheet 32, 34 is selected from the group consisting of plastic film sheeting and rubberized sheeting. As in the illustrated embodiment of FIG. 1, moisture impervious sheet 32, 34 consists of a solid single layered vinyl sheet. Moisture impervious sheet 32, 34 can generally range in thickness from about 1 mil to 25 mil for most crawlspace applications, but the present invention is not to be constructed as limited to this range of thickness, which is cited by way of example only.

Figure 4:
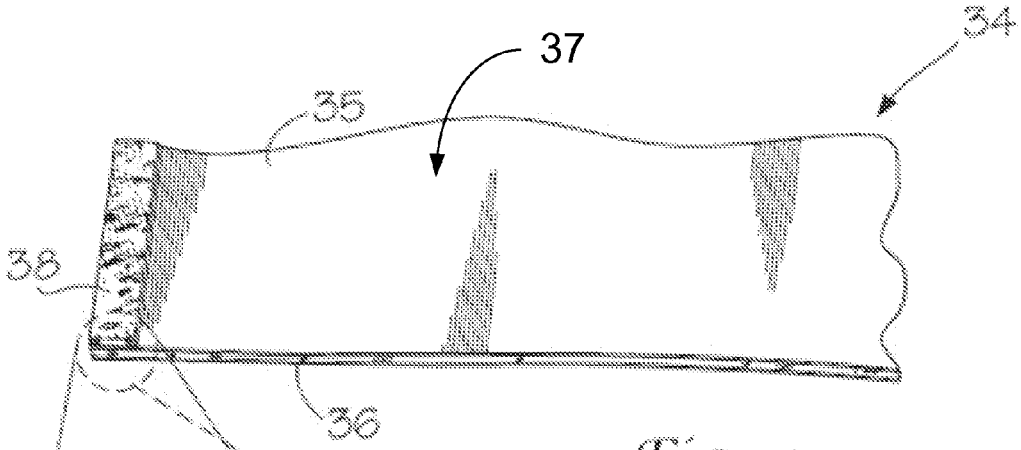
FIG. 4 shows a perspective view of an alternative embodiment of the moisture impervious sheet carrying an adhesion strip according to the present invention; and, FIG. 5 shows a detailed cross-section view of a portion of FIG. 4.
Figure 5:
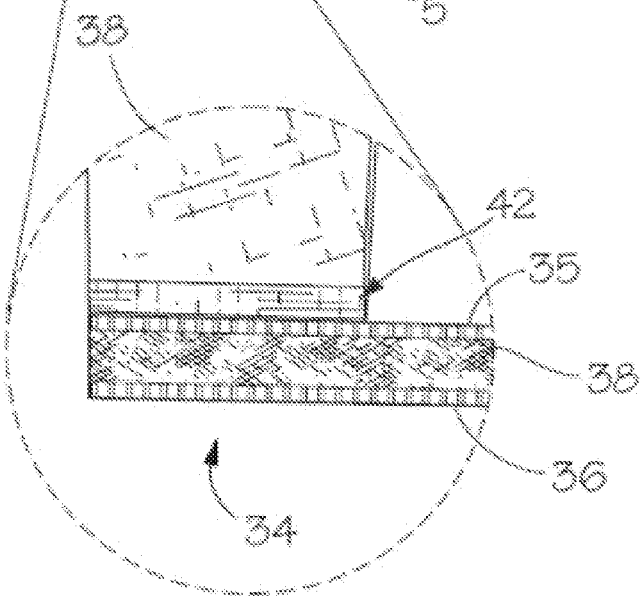

Referring to FIGS. 4 and 5, in an alternative embodiment, wall portion 34 and floor vapor barrier 32 include several layers including a core layer 38, a moisture impervious generally solid top layer 36 bonded to and completely covering a first side of core layer 38, and a moisture impervious generally solid bottom layer 35 bonded to and completely covering a second side of core layer 38 opposite the first side. In one embodiment, core layer 38 can comprise a woven or non-woven fabric material to provide strength and puncture resistance. Further, the top layer 36 and the bottom layer 35 may be selected from the group consisting of plastic films and rubberized sheeting to provide for the generally moisture impervious nature required of vapor barrier 50.

Referring to FIGS. 1, 3A and 3B, vapor barrier 50 further includes an adhesion strip 42 secured to first exterior side surface 37. Adhesion strip 42 is specifically adapted to absorb an adhesive placed on foundation wall 22 for securing the moisture impervious sheet wall portion 34 to the foundation wall. In an alternative embodiment of FIGS. 4 and 5, adhesion strip 42 is secured to first exterior side surface 37 on bottom layer 35.

Adhesion strip 42 comprises a porous synthetic fibrous web capable of distributing adhesive 44 (FIGS. 3A and 3B) completely through adhesion strip 42 to first exterior side surface 37 of moisture impervious sheet wall portion 34 during mounting to foundation wall 22 so that an air and moisture tight seal is formed between the foundation wall, adhesion strip, and moisture impervious sheet. Adhesion strip 42 may be selected from the group consisting of woven and non-woven synthetic fabric materials. Natural fibers are not ideal for crawlspace application as they will degrade and decay, thus eventually allowing air and moisture to pass through. In one preferred embodiment, adhesion strip 42 comprises non-woven hydroentangled spun-lace PET polyester fibers entangled in both a vertical and horizontal direction to promote strength and durability. In a further advantageous embodiment, adhesion strip 42 is selected with a weight in the range of 5-300 grams per square meter (gsm) providing a high void volume to facilitate absorption of adhesive 44 through to first exterior side surface 37 of moisture impervious sheet wall portion 34. Because the adhesives used in this type of application are relatively thick and of paste like consistency, if adhesion strip 42 is not sufficiently porous then the adhesive will not travel completely through to the moisture impervious sheet. This would allow for air and moisture to pass through the adhesion strip in an unwanted manner. Accordingly, providing an adhesion strip in the range of approximately 5-300 gsm ensures sufficient porosity to allow the construction grade adhesives to be absorbed and distributed through adhesion strip 42 to first exterior side surface 37 of moisture impervious sheet wall portion 34. Preferably, adhesion strip 42 is also treated with fire retardant and a antimicrobial treatment.

Adhesion strip will typically range in thickness from approximately 1-20 mil to support moisture impervious sheet wall portion 34 and so that adhesive 44 is absorbed completely through to first exterior side surface 37. The heavier the moisture impervious sheet, the thicker adhesion strip 42 must be to support it on foundation wall 22.

Adhesion strip 42 can be glued to first exterior side surface 37 using a water-based, solvent based, PUR, silicone, epoxy, acrylic, or any conventional or cross linkable hot melt adhesive, or thermoplastic. These adhesives can be applied using, spray, roll coat, slot die (extrusion), gravure, or similar methods. In one arrangement, adhesion strip 42 is secured to first exterior side surface 37 of moisture impervious sheet wall portion 34 using an adhesive film applied to a back side 39 of adhesion strip 42. Alternatively, adhesion strip 42 can be secured to first exterior side surface 37 of using a double-sided adhesive tape. In this arrangement, it is preferably that a dry mount adhesive be carried on a first side bonding to adhesion strip 42, and a second side carry an adhesive selected from the group consisting of a pressure sensitive adhesive, heat activated adhesive, and solvent activated adhesive. Utilizing a dry mount adhesive prevents over absorption of the adhesive into the porous adhesion strip while still securely bonding.

To install the vapor barrier 50, a moisture impervious sheet as detailed above is selected. The adhesion strip 42 is non-releasably bonded to first exterior side surface 37 of moisture impervious sheet wall portion 34, wherein adhesion strip 42 comprises a porous synthetic fibrous web adapted to absorb and distributing adhesive 44 completely through adhesion strip 42 to first exterior side surface 37, and wherein adhesion strip 42 is capable of supporting the full weight of moisture impervious sheet wall portion 34 in a vertical hanging arrangement. A bead of adhesive 44 is applied to foundation wall 22 and the moisture impervious sheet wall portion 34 aligned so that first exterior side surface 37 extends adjacent to and downward along foundation wall 22. Adhesion strip 42 is then pressed into the bead of adhesive 44 so that adhesive 44 is absorbed and extends through to first exterior side surface 37 forming an air and moisture tight seal between foundation wall 22, adhesion strip 42, and moisture impervious sheet wall portion 34.

Thus, by providing a porous fabric adhesion strip 42 secured to an exterior side surface of a moisture impervious sheet, a nonvolatile low-VOC compliant non-solvent adhesive can be used in the crawlspace to secure wall portion 34 to foundation walls 22 without any mechanical fasteners or concerns with adhesives that are not low-VOC compliant. In a further embodiment, adhesion strip 42 can also be used in securing insulation sheets to a foundation wall, which typically included a rigid foam core covered by paper or metallic foil sheet top and bottom layers. Accordingly, adhesion strip 42 would be secured to the paper or metallic bottom layer using an adhesive in the same manner as described above for wall portion 34. In this arrangement adhesion strip 42 is preferably selected from the woven or non-woven flexible fabric material as detailed above.

The adhesion strip 42 of the vapor barrier 50 is generally located along a top edge of wall portion 34 on the side adjacent foundation wall 22. Preferably, adhesion strip 42 is approximately a one to two inch long strip of material extending downward from the top edge to provide sufficient surface area for receiving the fire retardant low-VOC compliant non-solvent adhesive 44. Adhesion strip 42 extends longitudinally along the entire length wall portion 34 parallel to the top edge to provide continuous area for adhesive 44 to secure and mount wall portion 34 to the foundation walls in an air and moisture tight arrangement.

In the illustrated embodiment, wall portion 34 includes a tail section 54 extending horizontally outward from a base of foundation wall 22 along the ground. Floor cover 32 is then installed in an overlapping arrangement with at least a portion of tail section 54 along a bottom edge of wall portion 34. In one embodiment, the floor section overlaps the wall section by at least six inches. A sealing tape 46 is then disposed over a seam defined by the overlapping of floor cover 32 on wall portion 34 so that the wall portion and floor cover are secured together on tail section 54 to resist moisture and vapor transfer through the seam. In one embodiment, the sealing tape is four inches wide. Preferably, floor cover 32 is the same material as wall portion 34.

A fire retardant low-VOC compliant non-solvent adhesive 44 is used to secure adhesion strip 42 directly to foundation walls 22. Further, due to the improved adhesive surface provided by adhesion strip 42, it becomes possible to use a low-VOC grade adhesive. By using a fire retardant low-VOC compliant non-solvent adhesive, there are significant safety and health benefits from the non-volatile nature of such adhesive in the crawlspace environment where there is limited ventilation. Additionally, the adhesive should be non-toxic since the adhesive will be applied in the crawlspace environment where air is directed upward into the living space above. Accordingly, a sufficient bond is formed to support the wall portion 34 on foundation walls 22 without the need for mechanical fasteners, while also providing an air and moisture tight seal. The adhesive is preferably a polyurethane base.

VOC levels are expressed in pounds per gallon (lbs/gal) or grams per liter (g/l). Generally, a product is given a low-VOC compliant mark if it has a VOC content that off-gases less than 50 g/l. 20. Preferably, the fire retardant low-VOC compliant non-solvent adhesive 44 of the present invention off-gases approximately 20 g/l or less.

In one embodiment, there is a gap 48 (FIG. 1) between the top of the foundation wall and the top edge of wall portion 34. This gap allows for subsequent inspection of the foundation wall such as those for termites. In one embodiment, the gap is three inches.

Further, wall portion 34 and floor cover 32 can have an R value in that it provides insulation to the foundation walls and crawlspace. This is particularly true when the barrier is constructed with 20 mil material with a core between two external plastic layers (FIGS. 4 and 5). Further, a vapor barrier 50 with a sufficient fire rating and low-VOC is desirable. The barrier can be fire retardant such that the barrier has a fire rating (FR) rating.

Prior to installing the vapor barrier, an antimicrobial spray can be applied so areas that are prone to moisture can be treated in anticipation of water leaks. For example, under bathrooms and laundry rooms, there is a possibility of water leaking into the crawlspace. The interior walls of the crawlspace that are adjacent to the exterior of the structure can have insulation applied to increase the insulation of the structure. This minimizes the amount of heat transfer from the crawlspace and the exterior of the structure. A sealant can be placed between the top of the foundation wall and the sill plate at 40 to further provide a barrier for moisture, insects, and other items from entering the crawlspace in gaps or spaces between the foundation wall and sill joist. The vapor barrier properties of fire retardant and antimicrobial may be inherent to the specific materials selected, or may be a chemical treatment applied to the vapor barrier.

In alternative embodiments, the invention can include the addition of a dehumidifier which can be installed so that proper humidity levels are maintained. Circulation fans can be placed to assist the dehumidifiers so that even air conditions result. Humidistat controls can be used to conserve energy and have the circulation fans operate according to detected humidity levels rather than simply having fans manually actuated or running all the time. Lighting can be added during the crawlspace enclosing process so that subsequent inspections and future crawlspace access is made easier. In the event that the air is conditioned with the dehumidifiers or fans, vents can be sealed to remove the opening to the exterior of the structure further reducing the moisture that can enter the crawlspace. Humidity can be monitored within the crawlspace by installing a remote monitor panel that displays readouts of sensors within the crawlspace for detecting temperature and humidity.

This invention can be professionally installed or provided in a do-it-yourself kit. In one embodiment, the do-it-yourself kit includes the crawlspace vapor barrier, antimicrobial spray, adhesive and humidity and temperature monitor. The kit can include instructions and specifications for purchasing dehumidifier, circulation fans, humidistat controls for circulation fans, lighting, electrical wiring, boxes and breakers, insulating the foundation wall, minimum inch termite inspection gap, insulating the band joist space, sealing the sill plate, sealing off existing crawlspace vents, access doors and panels, condensate drain piping or pumps and installation instructions.

While a preferred embodiment of the invention has been described using specific terms, such description is for illustrative purposes only, and it is to be understood that changes and variations may be made without departing from the spirit or scope of the following claims.

What is claimed is:

1. A vapor barrier for mounting and sealing on a foundation wall using adhesive, said vapor barrier comprising:

a moisture impervious sheet having a first exterior side surface arranged to extend adjacent to and downward along said foundation wall when mounted;

an adhesion strip secured to said first exterior side surface absorbing an adhesive placed on the foundation wall for securing said moisture impervious sheet to the foundation wall;

wherein said adhesion strip comprises a porous synthetic fibrous web, and wherein said adhesive is distributed completely through said adhesion strip to said first exterior side surface of said moisture impervious sheet when mounted to said foundation wall defining an air and moisture tight seal between the foundation wall, said adhesion strip, and said moisture impervious sheet.

2. The vapor barrier of claim 1, wherein said porous synthetic fibrous web consists of non-woven hydroentangled spun-lace PET polyester fibers entangled in both a vertical and horizontal direction to promote strength and durability.

3. The vapor barrier of claim 1, wherein said adhesion strip is selected with a weight in the range of 5-300 grams per square meter providing a void volume to facilitate absorption of said adhesive through to said moisture impervious sheet.

4. The vapor barrier of claim 1, wherein said moisture impervious sheet is selected from the group consisting of plastic film sheeting and rubberized sheeting.

5. The vapor barrier of claim 4, wherein said moisture impervious sheet consists of a solid single layered vinyl sheet.

6. The vapor barrier of claim 1, wherein said adhesion strip is secured to said first exterior side surface of said moisture impervious sheet using an adhesive selected from the group consisting of water-based, solvent based, PUR, silicone, epoxy, acrylic, conventional or cross linkable hot melt adhesive, and thermoplastics.

7. The vapor barrier of claim 1, wherein said adhesion strip is secured to said first exterior side surface of said moisture impervious sheet using an adhesive film carried on a back side of said adhesion strip.

8. The vapor barrier of claim 1, wherein said adhesion strip is secured to said first exterior side surface of said moisture impervious sheet using a double-sided adhesive tape.

9. The vapor barrier of claim 8, wherein said double-sided adhesive tape includes a dry mount adhesive on at least one side for bonding to said adhesion strip.

10. The vapor barrier of claim 1, wherein said adhesion strip is selected from the group consisting of woven and nonwoven synthetic fabric materials.

11. The vapor barrier of claim 1, wherein at least one of said adhesion strip and said moisture impervious sheet includes at least one of a fire retardant and a antimicrobial treatment.

12. The vapor barrier of claim 1, wherein said adhesion strip ranges in thickness from approximately 1-20 mil to support said moisture impervious sheet and so that said adhesive is absorbed completely through to said moisture impervious sheet.

13. A method of installing a vapor barrier to a foundation wall comprising the steps of:

providing a moisture impervious sheet;

non-releasably bonding an adhesion strip to a first exterior side surface of said moisture impervious sheet, wherein said adhesion strip comprises a porous synthetic fibrous web absorbing and distributing an adhesive completely through said adhesion strip to said first exterior side surface of said moisture impervious sheet so that said adhesion strip supports said moisture impervious sheet in a vertical hanging arrangement;

applying a bead of adhesive to said foundation wall;

aligning said moisture impervious sheet to said foundation wall so that said first exterior side surface extends adjacent to and downward along said foundation wall;

pressing said adhesion strip into said bead of adhesive so that said adhesive is absorbed and extends through to said first exterior side surface of said moisture impervious sheet forming an air and moisture tight seal between said foundation wall, said adhesion strip, and said moisture impervious sheet.

14. The method of claim 13, including the step of providing said adhesion strip consisting of non-woven hydroentangled spun-lace PET polyester fibers entangled in both a vertical and horizontal direction to promote strength and durability.

15. The method of claim 13, including the step of selecting said adhesion strip with a weight in the range of 5-300 grams per square meter providing a void volume to facilitate absorption of said adhesive through to said moisture impervious sheet.

16. The method of claim 13, including the step of selecting said moisture impervious sheet from the group consisting of plastic film sheeting and rubberized sheeting.

17. The method of claim 13, including the step of providing said adhesion strip having a thickness in the range of approximately 1-20 mil to support said moisture impervious sheet and so that said adhesive is absorbed completely through to said moisture impervious sheet.

18. The method of claim 13, including the step of non-releasably bonding said adhesion strip to said first exterior side surface of said moisture impervious sheet using an adhesive selected from the group consisting of water-based, solvent based, PUR, silicone, epoxy, acrylic, conventional or cross linkable hot melt adhesive, and thermoplastics.

19. The method of claim 13, including the step of applying an adhesive film to a back side of said adhesion strip for non-releasably bonding to said moisture impervious sheet.

20. The method of claim 13, including the step of applying a double-sided adhesive tape to a back side of said adhesions strip for non-releasably bonding to said moisture impervious sheet, wherein said double-sided adhesive tape includes a dry mount adhesive carried on at least a first side bonding to said adhesion strip, and a second side carrying an adhesive selected from the group consisting of a pressure sensitive adhesive, heat activated adhesive, and solvent activated adhesive.

* * * * *